US011291908B2

(12) United States Patent
Weckerle et al.

(10) Patent No.: US 11,291,908 B2
(45) Date of Patent: Apr. 5, 2022

(54) SNOWBOARD BINDING FORMED FROM TWO SEPARABLE PARTS

(71) Applicants: Johannes Weckerle, Munich (DE); Jakob Schneider, Munich (DE); Matthias Albrecht, Munich (DE)

(72) Inventors: Johannes Weckerle, Munich (DE); Jakob Schneider, Munich (DE); Matthias Albrecht, Munich (DE)

( * ) Notice: Subject to any disclaimer, the term of this patent is extended or adjusted under 35 U.S.C. 154(b) by 0 days.

(21) Appl. No.: 16/975,958

(22) PCT Filed: Feb. 26, 2019

(86) PCT No.: PCT/EP2019/054696
§ 371 (c)(1),
(2) Date: Aug. 26, 2020

(87) PCT Pub. No.: WO2019/162520
PCT Pub. Date: Aug. 29, 2019

(65) Prior Publication Data

US 2020/0398144 A1 Dec. 24, 2020

(30) Foreign Application Priority Data

Feb. 26, 2018 (DE) ..... 10 2018 202 874.5

(51) Int. Cl.
*A63C 10/08* (2012.01)
*A63C 10/04* (2012.01)
(Continued)

(52) U.S. Cl.
CPC ..... *A63C 10/045* (2013.01); *A63C 10/08* (2013.01); *A63C 10/103* (2013.01); *A63C 10/24* (2013.01)

(58) Field of Classification Search
CPC ..... A63C 10/045; A63C 10/08; A63C 10/103; A63C 10/24
See application file for complete search history.

(56) References Cited

U.S. PATENT DOCUMENTS 5,435,080 A * 7/1995 Meiselman ..... A43B 5/0401 280/14.21
5,820,155 A * 10/1998 Brisco ..... A63C 10/145 280/607
(Continued)

FOREIGN PATENT DOCUMENTS

DE 9421380 U1 10/1995
DE 10301163 A1 8/2003
(Continued)

OTHER PUBLICATIONS

International Application No. PCT/EP2019/054696, International Preliminary Report on Patentability dated May 23, 2019, 7 pages.
(Continued)

*Primary Examiner* — James A Shriver, II
*Assistant Examiner* — Michael T. Walsh
(74) *Attorney, Agent, or Firm* — Kilpatrick Townsend & Stockton LLP

(57) ABSTRACT

The present invention relates to a snowboard binding for coupling a snowboard shoe to a snowboard, comprising a baseplate, which is designed to be attached by means of a fastening device to a snowboard and to sit flat against same, a highback, which extends substantially perpendicularly to the baseplate, a toe strap, and an instep strap. The snowboard binding according to the invention is formed in two parts, wherein the baseplate and the toe strap are associated with a first module and the highback and the instep strap are associated with a second module. A coupling unit is provided, by means of which the first module and the second module can be releasably coupled to one another, the first module being designed to remain on the snowboard in a decoupled state and the second module being designed to remain on the snowboard shoe in the decoupled state.

20 Claims, 2 Drawing Sheets

(51) Int. Cl.
*A63C 10/10* (2012.01)
*A63C 10/24* (2012.01)

(56) References Cited

U.S. PATENT DOCUMENTS

| | | | | | |
|---|---|---|---|---|---|
| 6,007,077 | A * | 12/1999 | Moe | A63C 10/045 | 280/14.22 |
| 6,270,109 | B1 * | 8/2001 | Turner | A63C 10/10 | 280/613 |
| 6,464,237 | B1 * | 10/2002 | Gracie | A63C 10/045 | 280/14.24 |
| 2002/0153704 | A1 | 10/2002 | Okajima et al. | | |
| 2002/0180182 | A1 * | 12/2002 | Dennis | A63C 10/10 | 280/618 |
| 2004/0232658 | A1 * | 11/2004 | Poscich | A63C 10/04 | 280/618 |
| 2007/0114763 | A1 * | 5/2007 | Reuss | A43B 5/0482 | 280/623 |
| 2016/0136505 | A1 * | 5/2016 | Kavarsky, Jr. | A43B 5/0403 | 280/624 |
| 2020/0384344 | A1 * | 12/2020 | Boult | A63C 10/14 | |

FOREIGN PATENT DOCUMENTS

| | | | | | |
|---|---|---|---|---|---|
| EP | 0740908 | A1 | 11/1996 | | |
| EP | 0753269 | A1 | 1/1997 | | |
| EP | 1348469 | A2 | 10/2003 | | |
| EP | 3693065 | A1 * | 8/2020 | A63C 10/145 | |
| FR | 2732230 | A1 | 10/1996 | | |
| WO | WO-9640390 | A1 * | 12/1996 | A63C 10/06 | |
| WO | WO-9739808 | A1 * | 10/1997 | A63C 10/24 | |
| WO | 9847398 | A1 | 10/1998 | | |
| WO | WO-9847398 | A1 * | 10/1998 | A63C 10/04 | |
| WO | WO-9847580 | A1 * | 10/1998 | A63C 10/10 | |

OTHER PUBLICATIONS

German Application No. 10 2018 202 874.5, German Search Report dated Nov. 22, 2018, 2 pages.

International Application No. PCT/US1998/07883, International Search Report dated Aug. 21, 2018, 32 pages.

* cited by examiner

SNOWBOARD BINDING FORMED FROM TWO SEPARABLE PARTS

CROSS REFERENCE TO RELATED APPLICATION

This application claims priority to German Patent Application No. 10 2018 202 874.5, filed in Germany on Feb. 26, 2018, the entire contents of which are hereby incorporated herein by this reference.

The present invention relates to a snowboard binding comprising a baseplate, which is designed to be attached by means of a fastening device to a snowboard and to sit flat against same, a highback, which extends substantially perpendicularly to the baseplate, a toe strap, and an instep strap.

Such generic snowboard bindings are known per se and are used in pairs to connect the snowboard to the snowboard shoes of a user, i.e. a snowboarder. In such known bindings, the coupling between the binding and the shoe is generally produced in such a way that first the toe straps and instep straps, which are usually equipped with ratchets, are opened, then the shoe is placed in the intended position thereof on the baseplate, and then the two straps are threaded and tightened again. To put on the snowboard using the binding, however, it is necessary for the user to sit down and usually carry out the threading and tightening process while wearing gloves, which many snowboarders find annoying.

On the other hand, so-called "flow bindings" have recently come onto the market, in which the highback can be folded backwards for insertion, in order to provide an insertion opening for the user's shoe, and it can be folded up again and secured after inserting the foot. In this case, however, sufficient space behind the binding is necessary for this pivoting movement of the highback, such that it is not possible to step into the binding for example on steep slopes, since there is no suitable space for pivoting the highback. Furthermore, the highback in such bindings must have a positioning angle of at least 5° in the closed state, which limits the flexibility of such systems. Finally, the individual adjustment and the actuation of flow bindings are complex because these bindings comprise a total of four buckles and ultimately have to be opened and closed manually.

Finally, so-called "step-in bindings" were also available for some time, in which a specially formed shoe could be snapped onto a baseplate on the snowboard. However, since this required the expensive new purchase of these special shoes, which also had to be reinforced and were therefore not very flexible, and because such systems were perceived by snowboarders as insufficient in terms of power transmission and thus driving experience, and in terms of the operation thereof when soiled by snow or ice, these systems could not succeed on the market.

It is therefore the object of the present invention to provide an improved snowboard binding of the type in question which, with unchanged travel comfort and constant adjustment options, allows the snowboard to be attached and removed in a simplified manner.

For this purpose, the snowboard binding according to the invention is formed in two parts, the baseplate and the toe strap being associated with a first module and the highback and instep strap being associated with a second module, a coupling unit being provided by means of which the first and second modules can be releasably coupled to one another, wherein the first module is designed to remain in a decoupled state on the snowboard and the second module is designed to remain in a decoupled state on the snowboard shoe.

It is to the credit of the inventors to have recognised that the two-part construction of the snowboard binding according to the invention, with the second module remaining on the shoe, can make it easier to place on the snowboard, for example by targeted stepping-on, similar to an alpine ski binding, while no compromises have to be made with regard to the travel experience and/or the individual adjustment options for the binding. For example, in some embodiments of the invention, ratchet systems for adjusting the straps for adaptation to the relevant snowboard shoe can also be provided, and snowboard shoes that have already been purchased and were originally intended for use with conventional bindings can be used.

In order to be able to ensure a firm connection between the snowboard shoe and the second module even in the decoupled state, this second module can further comprise a bracket element in a preferred design, which bracket element, in the coupled state of the binding, points with its underside in the direction of the baseplate and is designed to form a contact surface for the sole of the snowboard shoe with its upper side. In this way, by providing the bracket element, a triangle of forces between the instep strap, the highback and the bracket element can be created, which substantially spans the region of the ankle or ankle joint of the wearer. A secure hold of the second module on the snowboard shoe is thus achieved, the shoe only having a small additional shoulder in the sole region thereof due to the bracket element in the decoupled state when the wearer is walking, but this does not substantially reduce the wearing comfort. As a result of this measure, snowboard shoes that have already been purchased and were originally intended for use with conventional bindings can also be used with the binding according to the invention. Alternatively, however, alternative measures for attaching the second module to the snowboard shoe would of course also be conceivable, for example via interacting engagement elements; however, these would require a redesign or at least modification of the snowboard shoe used.

To further improve the mobility of the ankle especially in the decoupled state of the binding according to the invention in the embodiment with the bracket element, it is possible to connect the highback, the instep strap and the bracket element to one another so as to be pivotable with respect to one another about a single pin. This pin will therefore extend in the width direction of the foot of the wearer or of the shoe in the region of the ankle of the wearer such that it substantially corresponds to the hinge axis of the ankle joint.

Furthermore, the first module can further comprise a wall element which extends substantially perpendicularly to the baseplate and in an arc shape around a rear region of the baseplate. The provision of a wall element improves the lateral support of the snowboard shoe in the binding and transmits forces between the foot of the snow boarder and his snowboard in the coupled state of the binding.

In the coupled state, this wall element can also form an abutment for the highback so that the pivoting movement thereof relative to the bracket element at a predetermined angle between the highback and the baseplate is limited, the predetermined angle preferably being adjustable by means of an adjustment mechanism. This makes it easy to ensure that the highback can also transmit forces from the wearers shoe to the snowboard and vice versa, the predetermined angle further being a substantial parameter of such bindings and being intended to be adaptable depending on the intended use or technique of the snowboarder. For this purpose, the adjustment mechanism can be formed, for example, in such a way that it comprises a counter element which can be displaced on the highback in the height direction and which, in the coupled state of the binding according to the invention, comes to sit directly against the wall element, the angle between the highback and the bracket element thus being adaptable by means of the position of the counter element.

Although the coupling unit of the snowboard binding according to the invention can be designed in different ways, a particularly simple and reliable option is for the coupling unit to comprise a first part, which comprises at least one engagement element, for example a toothed rack or a latching recess, and a second part, which comprises at least one displaceable latching tooth and a reset mechanism for the latching tooth, the reset mechanism preloading the at least one itching tooth for engagement with the at least one engagement element in the coupled state.

Depending on the embodiment of the coupling unit, said unit does not have to transmit particularly high forces, in particular if the above-mentioned wall element is provided which can absorb the principal forces acting which act transversely to the snowboarder's feet in the longitudinal direction of the snowboard. The same applies due to the support of the highback on the wall element, as a result of which the forces in the direction of the snowboarder's heel can be absorbed, such that the coupling unit merely has to ensure that the forces directed away from the snowboard are absorbed and that the first module and the second module of the binding according to the invention cannot be separated from one another unintentionally.

By providing the latching teeth mentioned and a counter element suitable for interacting therewith, the barbs of these latching teeth make it easy to step into the binding, i.e. the first and the second module can be coupled, the reset mechanism ensuring in the coupled state that the at least one latching tooth and the engagement element sit firmly against one another and thus secure the binding in the coupled state thereof.

While various mechanisms are also conceivable as the actuating element for opening the binding, for example suitably arranged push buttons for releasing the engagement between the at least one latching tooth and the engagement element, in a particularly user-friendly embodiment the actuating element can comprise a traction cable, by means of which the at least one latching tooth can be moved out of engagement with the at least one engagement element against the action of the reset mechanism. Deflecting the movement for actuating this traction cable, for example by an integrated lever mechanism, in such a way that the cable is actuated in the direction of stepping out of the binding can achieve an optimal force effect for releasing the shoe from the snowboard. Furthermore, it can be provided that the traction cable extends at least in portions in the region of the highback or within same and is preferably fixable thereon. This can ensure that the traction cable in the coupled state of the binding according to the invention does not hinder the snowboarder while travelling, and a visually appealing appearance can also be achieved. To secure the traction cable to the highback, a latching mechanism can be provided, for example, which firmly connects the traction cable to the highback in the locked state and releases it only in the unlocked state to open the binding.

Although the two parts of the coupling unit can be freely associated with the two modules, the first part of the coupling unit can be associated with the first module and the second part of the coupling unit can be associated with the second module, in particular to facilitate operation when opening the binding.

In order to ensure optimum force absorption and simple operation of the binding according to the invention, one of the parts of the coupling unit can be associated with the bracket element and the other part of the coupling unit can be associated with the wall element.

Furthermore, the present invention relates to a system comprising a snowboard binding according to the invention and a snowboard shoe which is designed to be connectable to the second module of the binding. Here, one of the advantages of the present invention is that no substantial modifications need to be made to the snowboard shoe compared to known snowboard shoes, and even snowboard shoes which are already in circulation can possibly be used in the system according to the invention.

Furthermore, the system according to the invention can comprise two snowboard bindings according to the invention, two snowboard shoes and also a snowboard to which the baseplates of the two snowboard bindings can be attached by means of the fastening devices thereof, the fastening devices preferably also allowing adjustment to the attachment with regard to the position and/or angle thereof with respect to the upper side of the snowboard. These adjustments can be made, for example, by means of a washer having four screws, which allows the shoe axis to be adjusted relative to the snowboard axis.

Further features and advantages of the present invention will become apparent from the following description of an embodiment when considered together with the accompanying drawings. In the drawings, shown in detail:

Figure 1:
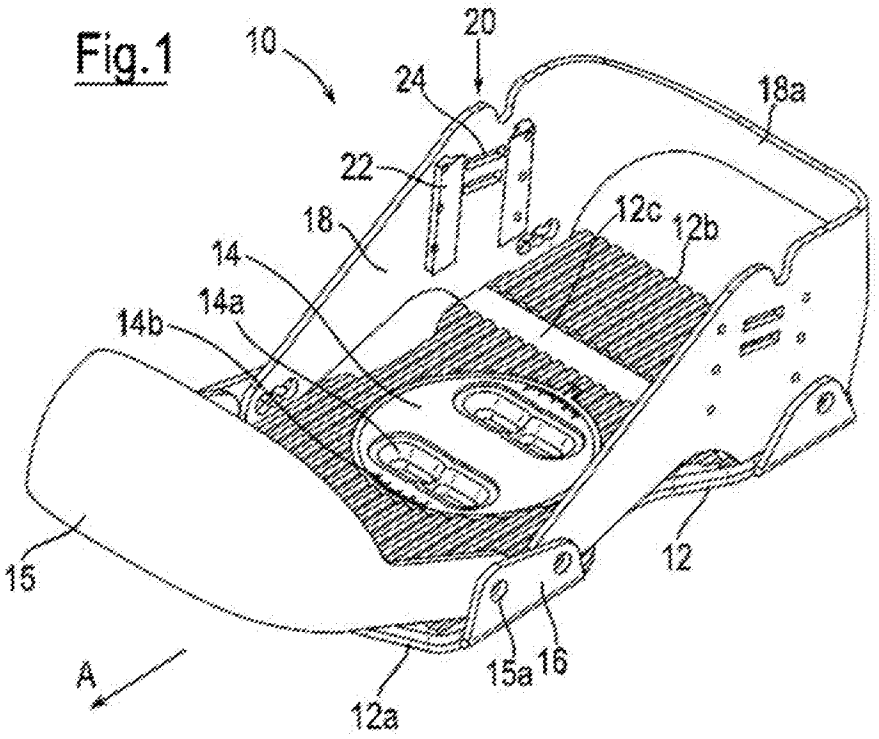
FIG. 1 shows a first module of a snowboard binding according to the invention.

In FIG. 1, a first module of a snowboard binding according to the invention is shown and generally denoted by the reference numeral 10. The first module comprises a baseplate 12 which is provided and designed to be mounted on a snowboard and then to sit flat against the snowboard with the underside thereof. For this purpose, a fastening disk 14, often referred to as a "mini disk", is provided in a central recess in the baseplate 12, which has mounting holes 14*a* for screwing in screws for a connection to the snowboard and which can be rotated relative to the baseplate in order to set the desired angle between the longitudinal axis of the snowboard and the longitudinal axis A of the baseplate. A scale 14*b* is also arranged on the fastening disk 14, by means of which scale precise setting of the said angle is possible.

Furthermore, the first module 10 comprises a toe strap 15 which extends substantially in an arc shape in the region of the front region 12*a* in the baseplate axis A of the baseplate 12 from two fastening points, of which only one fastening point 15*a* is shown in the view shown in FIG. 1. The toe strap 15 is in this case pivoted about the two attachment points 15*a* to opposite mounting portions 16 which extend perpendicularly to the baseplate 12, such that individual adjustment of the position of the toe strap 15 relative to the baseplate 12 is possible. Although the toe strap 15 is shown in one piece in the embodiment shown in FIG. 1, in other embodiments of the binding according to the invention it can also be adjustable in length in a known manner, for example via a ratchet system.

In yet another embodiment, the toe strap 15 could also be designed as a cap which, in the coupled state, protrudes over the entire front of the snowboard shoe, that is to say extends both in front of and over the toes of the shoe.

Also attached to the mounting portion 16 is a wall element 18, which likewise extends substantially perpendicularly upward from the baseplate 12, substantially follows the shape of the baseplate 12 laterally and describes an arch 18*a* in the rear region 12*b* of the baseplate 12.

On the lateral inner portions of the wall portion 18 there is also a two-part first part 20 of a coupling unit, by means of which part the coupling of the first module 10 to the second module 30 shown in FIG. 2 and described below is achieved. In the illustration from FIG. 1, only the right-hand part of the first part 20 of the coupling unit is shown; however, an identically designed module, i.e. the left-hand part of the first part 20 of the coupling unit, is mirrored with respect to the longitudinal axis of the baseplate 12 on the other side of the wall element 18. The two first parts 20 of the coupling unit mentioned above each comprise a pair of guide rails 22 and two engagement elements 24 in the form of latching openings. These latching openings 24 are designed such that the latching teeth 28 shown in FIG. 2, which are biased towards the outside by a spring element (not shown) and form part of the second part 26 of the coupling unit, can slide into them and, due to the barb shape of the latching teeth 28 and the bias from the spring element, cannot be easily pulled out again in the upward direction. Providing at least two latching openings 24 in each case can ensure that even if snow has accumulated, for example, on the sole of the snowboard shoe or on the inside of the baseplate, it is always possible to couple the binding, although if the snow subsequently melts or is removed, due to the shape of the latching teeth 28 it is only possible to further push the binding together.

Figure 2:
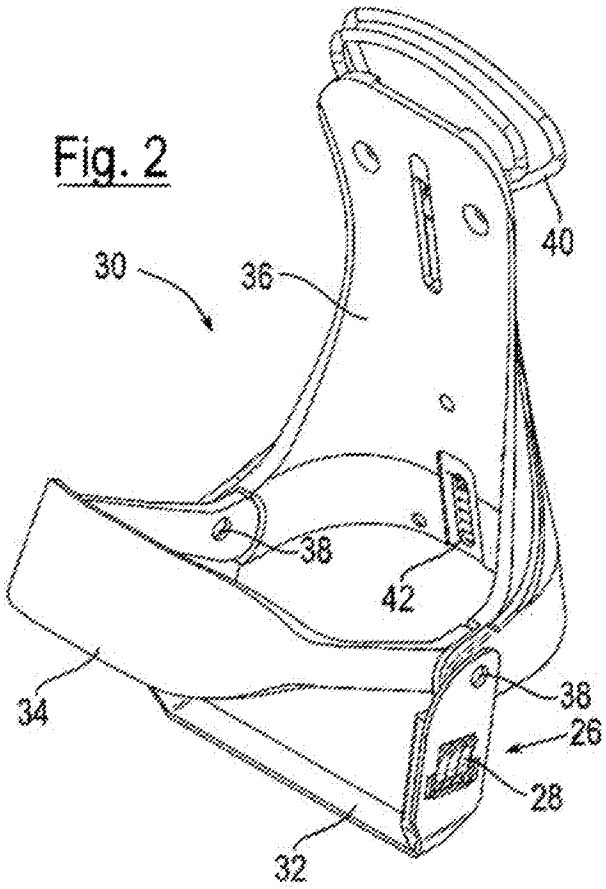
FIG. 2 shows the second module of the snowboard binding from FIG. 1.

The above-mentioned second part 26 of the coupling unit is provided on a bracket element 32 of the second module 30 of the snowboard binding according to the invention and is shown in FIG. 2. This bracket element 32 extends in portions below the position intended for a shoe and laterally upward in the second module 30 and, in the connected state of the two modules 10 and 30, can both be guided by the guide rails 22 and lie within a recess 12*c* provided for this purpose in the baseplate 12 of the first module 10.

Furthermore, the second module 30 comprises an instep strap 34, which is releasably connected to the other components of the second module 30 in order to allow placement on a snowboard shoe and which, like the toe strap 15 in the embodiment shown, is formed in one piece, but could also be adjustable in length by means of a ratchet system, as well as a highback 36, which extends substantially perpendicularly and in an arc shape and to a certain extent follows the calf of a wearer in order to allow support and power transmission between the snowboarders leg and his snowboard in this direction.

The components of the bracket element 32, instep strap 34 and highback 36 are pivotally connected to one another so as to be pivotable with respect to one another about a pin 38, which extends substantially in the region of the hinge axis of the ankle joint of the wearer. The connection itself can be formed, for example, by a pair of screws or rivets, which accordingly connect the three components mentioned on both sides of the ankle of the wearer, it being possible to open the instep strap 34 and thus place it on a snowboard shoe by releasing this connection on one side or by separating the above-mentioned ratchet system.

In the region of the highback 36, two loops 40 formed, for example, from a wrapped wire cable can further be seen in FIG. 2, which loops form part of a release device for the coupling unit and in particular for the two-part second part 26 thereof. For this purpose, the loops 40 are parts of cables which are connected to the latching teeth 28 in such a way that pulling the loops 40 in the upward direction causes the latching teeth 28 to be drawn in the direction of the foot of the wearer, so that the teeth can come out of engagement with the latching openings 24 in the coupled state of the coupling unit and the coupling unit is released in such a way that the second module 30 can be released from the first module 10. The cables extend within the highback 36 and, in variants of the binding according to the invention, can be fixed in order to prevent accidental actuation.

Finally, FIG. 2 also shows an adjustable counter element 42 associated with the highback 36, which counter element acts in such a way that, when the two modules 10 and 30 are coupled, it sits directly against the wall element 18 in the region of the arch 18*a*; in this case, the angle between the highback 36 and the bracket element 32 can be adapted in the coupled state by means of the position of the counter element 42 on the highback 36 in relation to the height direction.

Figure 3B:
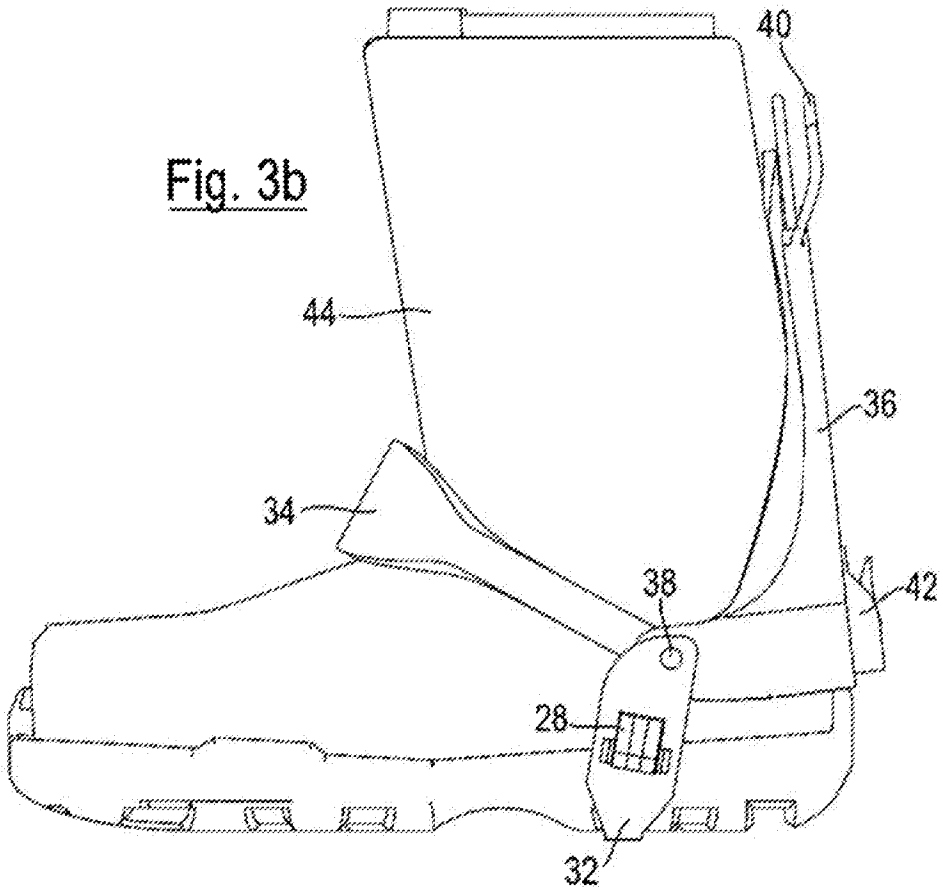
FIGS. 3*a* and 3*b* are rear and side views of the second module from FIG. 2 connected to a snowboard shoe.
Figure 3A:
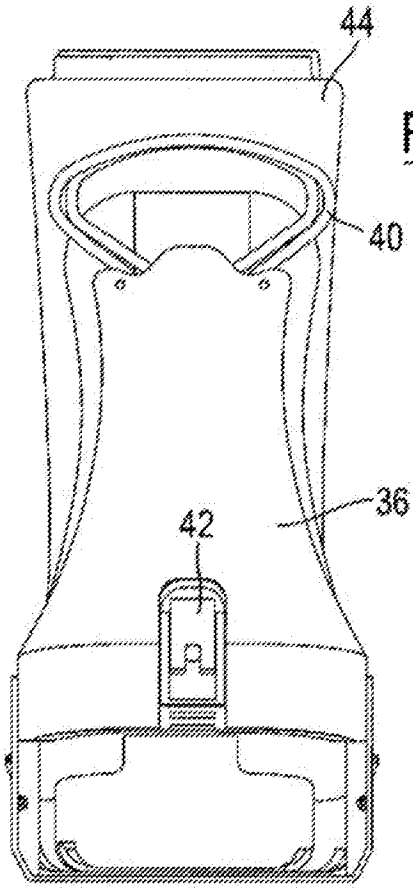

The counter element 42 can be seen again in FIGS. 3*a* and 3*b*, each of which shows the second module 30 from FIG. 2 connected to a commercially available snowboard shoe 44 (soft shoe) in rear and side views. It is clear from these two illustrations that, in the decoupled state of the snowboard binding according to the invention, the second module 30 is held on the shoe 44 by the triangle formed by the bracket element 32, the instep strap 34 and the highback 36, excellent mobility of the ankle of the wearer of the shoe 44 remaining ensured due to the pivotability of the three components mentioned with respect to one another about the pin 38, such that wearing the second module 30 on the shoe 44 is not perceived as a nuisance.

The invention claimed is:

1. A snowboard binding for coupling a snowboard shoe to a snowboard, comprising:

a baseplate that is attachable by means of a fastening device to a snowboard to sit flat against the snowboard;

a highback that extends substantially perpendicularly to the baseplate;

a toe strap; and an instep strap, wherein the snowboard binding is formed from two modules, the baseplate and the toe strap being associated with a first module, the highback and the instep strap being associated with a second module, the first module and the second module releasably coupled by a coupling unit in a coupled state, wherein the first module is designed to remain on the snowboard in a decoupled state and the second module is designed to remain on a snowboard shoe in the decoupled state.

2. The snowboard binding according to claim 1, wherein the second module further comprises a bracket element comprising an underside and an upper side, wherein, in the coupled state of the snowboard binding, the bracket element is oriented with the underside in a direction of the baseplate to form a contact surface for the sole of the snowboard shoe with the upper side.

3. The snowboard binding of claim 2, wherein the highback, the instep strap, and the bracket element are connected to one another so as to be pivotable with respect to one another about a single pin.

4. The snowboard binding of claim 1, wherein the first module further comprises a wall element that extends substantially perpendicularly to the baseplate and in an arc shape around a rear region of the baseplate.

5. The snowboard binding of claim 4, wherein, in the coupled state, the wall element forms an abutment for the highback so that a pivoting movement of the highback relative to a bracket element is limited to a predetermined angle between the highback and the baseplate.

6. The snowboard binding according to claim 1, wherein the coupling unit comprises:

a first part comprising at least one engagement element comprising a toothed rack or a latching recess, and a second part comprising at least one displaceable latching tooth and a reset mechanism for the latching tooth, the reset mechanism preloading the at least one displaceable latching tooth for engagement with the at least one engagement element in the coupled state.

7. The snowboard binding of claim 6, further comprises an actuating element comprising a traction cable by means of which the at least one latching tooth can be moved out of engagement with the at least one engagement element against an action of the reset mechanism.

8. The snowboard binding of claim 7, wherein the traction cable extends at least partly in a region of the highback or within the highback.

9. The snowboard binding of claim 6, wherein the first part of the coupling unit is associated with the first module and the second part is associated with the coupling unit of the second module.

10. The snowboard binding of claim 4, wherein the coupling unit is associated with a bracket element and with the wall element.

11. A system comprising:

a snowboard binding, comprising:

a baseplate that is attachable by means of a fastening device to a snowboard to sit flat against the snowboard;

a highback that extends substantially perpendicularly to the baseplate;

a toe strap; and an instep strap;

wherein the snowboard binding is formed from two modules, the baseplate and the toe strap being associated with a first module, the highback and the instep strap being associated with a second module, the first module and the second module releasably coupled by a coupling unit in a coupled state, wherein the first module is designed to remain on the snowboard in a decoupled state and the second module is designed to remain on a snowboard shoe in the decoupled state; and a snowboard shoe, wherein the snowboard shoe is connectable to the second module of the snowboard binding.

12. The system according to claim 11, comprising two snowboard bindings, two snowboard shoes, wherein the respective baseplates of the two snowboard bindings can be attached to the snowboard using respective fastening devices of the two snowboard bindings, each of the respective fastening devices allowing an adjustment to the attachment with regard to one or more of a position and an angle with respect to an upper side of the snowboard.

13. The system of claim 11, wherein the second module further comprises a bracket element comprising an underside and an upper side, wherein, in the coupled state of the snowboard binding, the bracket element is oriented with the underside in a direction of the baseplate to form a contact surface for the sole of the snowboard shoe with the upper side.

14. The system of claim 11, wherein the highback, the instep strap, and a bracket element are connected to one another so as to be pivotable with respect to one another about a single pin.

15. The system of claim 11, wherein the first module further comprises a wall element that extends substantially perpendicularly to the baseplate and in an arc shape around a rear region of the baseplate.

16. The system of claim 11, wherein the coupling unit comprises:

a first part comprising at least one engagement element comprising a toothed rack or a latching recess, and a second part comprising at least one displaceable latching tooth and a reset mechanism for the latching tooth, the reset mechanism preloading the at least one displaceable latching tooth for engagement with the at least one engagement element in the coupled state.

17. The snowboard binding of claim 16, further comprising an actuating element comprising a traction cable by means of which the at least one latching tooth can be moved out of engagement with the at least one engagement element against the action of the reset mechanism.

18. The system of claim 17, wherein the traction cable extends at least partly in the region of the highback or within the highback and is fixable on the highback.

19. The snowboard binding of claim 5, wherein the predetermined angle is adjustable by means of an adjustment mechanism.

20. The snowboard binding of claim 8, wherein the traction cable is fixable on the highback.

* * * * *